US009057550B2

(12) United States Patent
Bae et al.

(10) Patent No.: US 9,057,550 B2
(45) Date of Patent: Jun. 16, 2015

(54) REFRIGERATOR

(71) Applicant: LG ELECTRONICS INC., Seoul (KR)

(72) Inventors: Jungwook Bae, Changwon-si (KR); Dongseok Kim, Changwon-si (KR); Taehee Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 165 days.

(21) Appl. No.: 13/754,766

(22) Filed: Jan. 30, 2013

(65) Prior Publication Data

US 2013/0192285 A1 Aug. 1, 2013

(30) Foreign Application Priority Data

Jan. 31, 2012 (KR) ..... 10-2012-0009649

(51) Int. Cl.

| | |
|---|---|
| ***F25B 49/00*** | (2006.01) |
| ***F25B 49/02*** | (2006.01) |
| ***F25B 6/04*** | (2006.01) |
| *F25D 21/04* | (2006.01) |

(52) U.S. Cl.

CPC ..... *F25B 49/027* (2013.01); *F25B 6/04* (2013.01); *F25D 21/04* (2013.01); *F25B 2341/0661* (2013.01); *F25B 2400/0403* (2013.01); *F25B 2500/01* (2013.01); *F25B 2600/2501* (2013.01); *F25B 2600/2519* (2013.01); *F25B 2700/02* (2013.01)

(58) Field of Classification Search

CPC ..... F25B 2400/0411; F25B 2600/2501; F25B 2600/2503; F25B 2600/2507; F25B 2600/2515

USPC ..... 62/176.6, 197, 199, 511

See application file for complete search history.

(56) References Cited

U.S. PATENT DOCUMENTS

| | | | | |
|---|---|---|---|---|
| 5,231,847 | A * | 8/1993 | Cur et al. | 62/187 |
| 5,375,428 | A * | 12/1994 | LeClear et al. | 62/187 |
| 5,653,118 | A * | 8/1997 | Cocchi et al. | 62/197 |

* cited by examiner

*Primary Examiner* — Marc Norman

(74) *Attorney, Agent, or Firm* — Birch, Stewart, Kolasch & Birch, LLP

(57) ABSTRACT

A refrigerator is provided. The refrigerator includes an evaporator configured to evaporate a coolant and to cool a storage compartment, a compressor configured to compress the coolant evaporated in the evaporator, a condenser configured to condense the coolant compressed in the compressor, a hot line configured to receive condensed coolant, a first capillary tube configured to receive condensed coolant from the hot line, a second capillary tube configured to receive condensed coolant and arranged to allow bypassing of the hot line, a first coolant configured to adjust flow of condensed coolant from the hot line to the first capillary tube and a second coolant adjusting valve configured to control flow of condensed coolant from the condenser to the hot line and the second capillary tube.

12 Claims, 6 Drawing Sheets

REFRIGERATOR

CROSS-REFERENCE TO RELATED APPLICATION

This application claims priority to Korean Patent Application No. 10-2012-0009649 filed on Jan. 31, 2012, the contents of which are herein incorporated by reference in its entirety.

BACKGROUND OF THE INVENTION

1. Field of the Invention

The present invention relates to a refrigerator, and particularly, to a refrigerator including a hot line and a plurality of capillary tubes between a condenser and an evaporator.

2. Description of Related Art

In general, a refrigerator is an apparatus that keeps a storage compartment, such as a refrigerating compartment or a freezing compartment, at a low temperature by using a cooling cycle of a coolant, which consists of a compressor, a condenser, an expander, and an evaporator.

A refrigerator may include a main body that includes a storage compartment, such as a freezing compartment and a refrigerating compartment, and a door connected to the main body to open and close the storage compartment.

A difference in temperature occurs between the inside and outside of the refrigerator. In case the outside is left in a high-temperature, humid environment, water drops may be created on a portion of the main body, which contacts the door. This happens when room-temperature internal air transfers heat to low-temperature cold air so that the temperature of the low-temperature cold air goes up, thereby reaching the dew point. Water drops are mainly created on a region where the door contacts the main body due to a difference in temperature between the inside and outside of the refrigerator when the door is open.

In case a hot line is provided at the main body to be connected with the condenser, the refrigerator may remove water drops by making a coolant pass through the hot line.

In conventional refrigerators, a coolant which has passed through a hot line flows through one evaporator via only one expander. So, it is difficult to secure the optimum coolant circulation amount depending on load.

BRIEF SUMMARY OF THE INVENTION

An object of the present invention is to provide a refrigerator that may secure the optimum circulation amount of a coolant in case the coolant flows to the hot line via the condenser.

To achieve the above objects, a refrigerator according to the present invention includes an evaporator evaporating a coolant and cooling a storage compartment, a compressor compressing the coolant evaporated in the evaporator, a condenser condensing the coolant condensed in the compressor, a hot line through which the coolant condensed in the condenser passes, a first capillary tube through which the coolant having passed through the hot line passes, a second capillary tube through which the coolant condensed in the condenser passes by bypassing the hot line, a first coolant adjusting valve adjusting the coolant flowing from the hot line to the first capillary tube, and a second coolant adjusting valve adjusting the coolant flowing from the condenser to the hot line and the second capillary tube.

The first coolant adjusting valve may be a latch valve.

The second coolant adjusting valve may be a 3-way valve.

The second coolant adjusting valve may have a hot line mode in which the coolant having passed through the condenser is guided to the hot line, a second capillary tube mode in which the coolant having passed through the condenser is guided to the second capillary tube, and a simultaneous mode in which the coolant having passed through the condenser is guided to the hot line and the second capillary tube.

The refrigerator may include a controller controlling the compressor, the first coolant adjusting valve, and the second coolant adjusting valve.

The controller may control the second coolant adjusting valve in the second capillary tube mode during a preset time after the compressor is activated, and after the preset time passes, may control the second coolant adjusting valve in one of the hot line mode and the simultaneous mode.

The controller may control the second coolant adjusting valve in the second capillary tube mode before the compressor is stopped.

The refrigerator may include a temperature sensor sensing an indoor temperature and a humidity sensor sensing a humidity, wherein a hot line coolant supply time during which the coolant is supplied to the hot line is determined depending on sensing results of the temperature sensor and the humidity sensor.

The controller may control the second coolant adjusting valve in the simultaneous mode upon overload.

The controller may control the second coolant adjusting valve in one of the hot line mode and the second capillary tube mode upon a low load.

The first capillary tube and the second capillary tube may have the same inner diameter.

The first capillary tube may have an inner tube larger than an inner tube of the second capillary tube.

The refrigerator may include a first path along which the coolant flowing from the condenser sequentially passes through the hot line and the first capillary tube and a second path along which the coolant flowing from the condenser passes through the second capillary tube, wherein the first path and the second path are split past an outlet of the condenser in a coolant flowing direction and joins before reaching an inlet of the evaporator.

The second coolant adjusting valve may include a 3-way valve provided at a region where the first path and the second path are split.

The second coolant adjusting valve may include a first path 2-way valve provided at the first path and a second path 2-way valve provided at the second path.

The present invention may remove water drops by using a hot line with a simplified structure and may secure the optimum circulation amount corresponding to the load.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The embodiments of the present invention will become readily apparent by reference to the following detailed description when considered in conjunction with the accompanying drawings wherein.

DETAILED DESCRIPTION OF THE INVENTION

Hereinafter, embodiments of the present invention will be described in detail with reference to the accompanying drawings.

Figure 1:
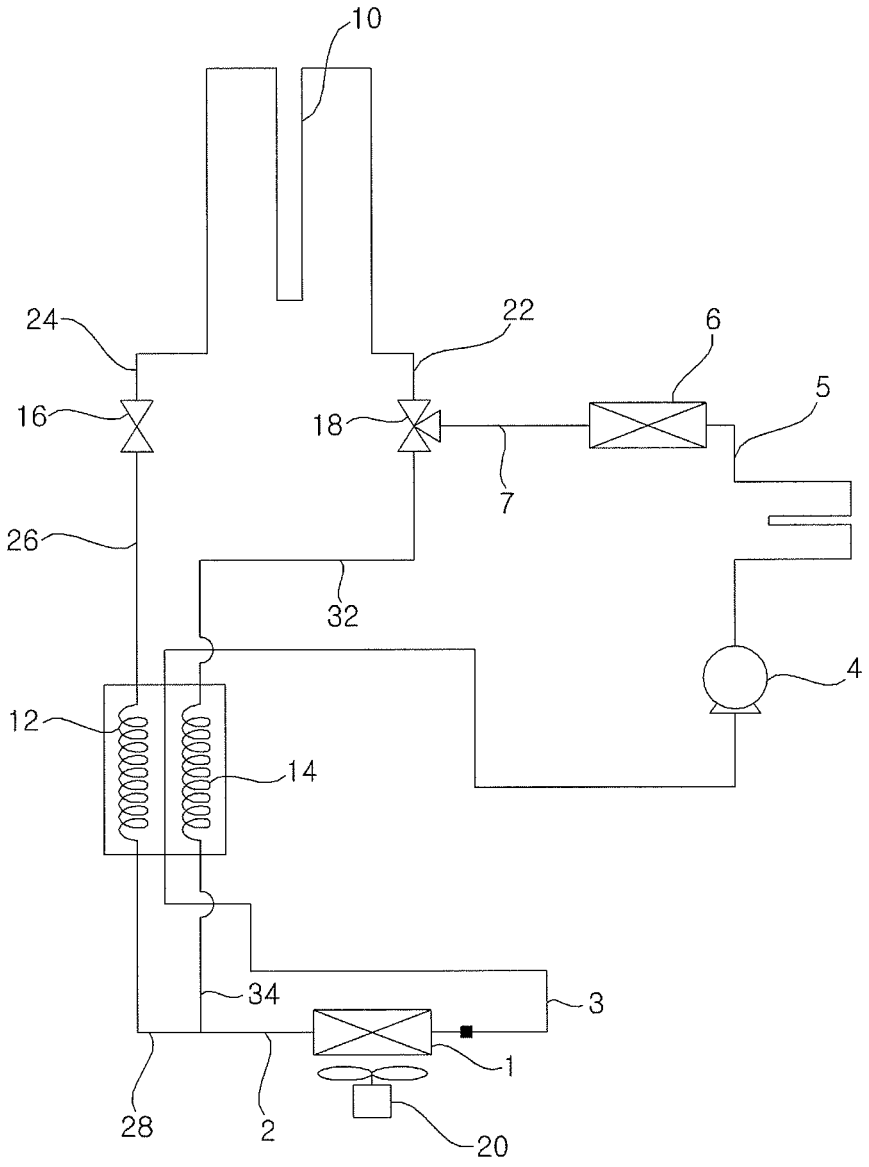
FIG. 1 is a configuration view illustrating an embodiment of a refrigerator according to the present invention.
Figure 2:
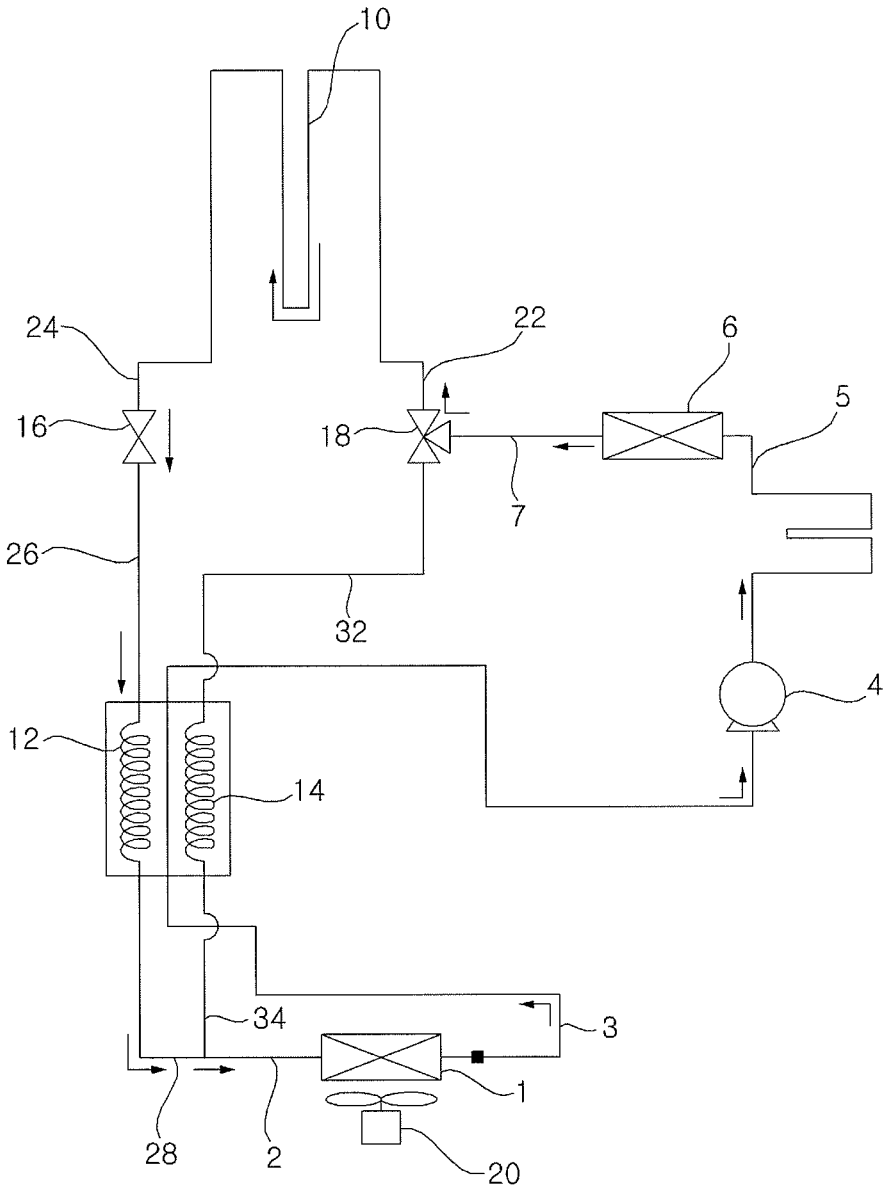
FIG. 2 is a configuration view illustrating a coolant flow in case a coolant, which passed through the condenser shown in FIG. 1 goes through a hot line and a first capillary tube.
Figure 3:
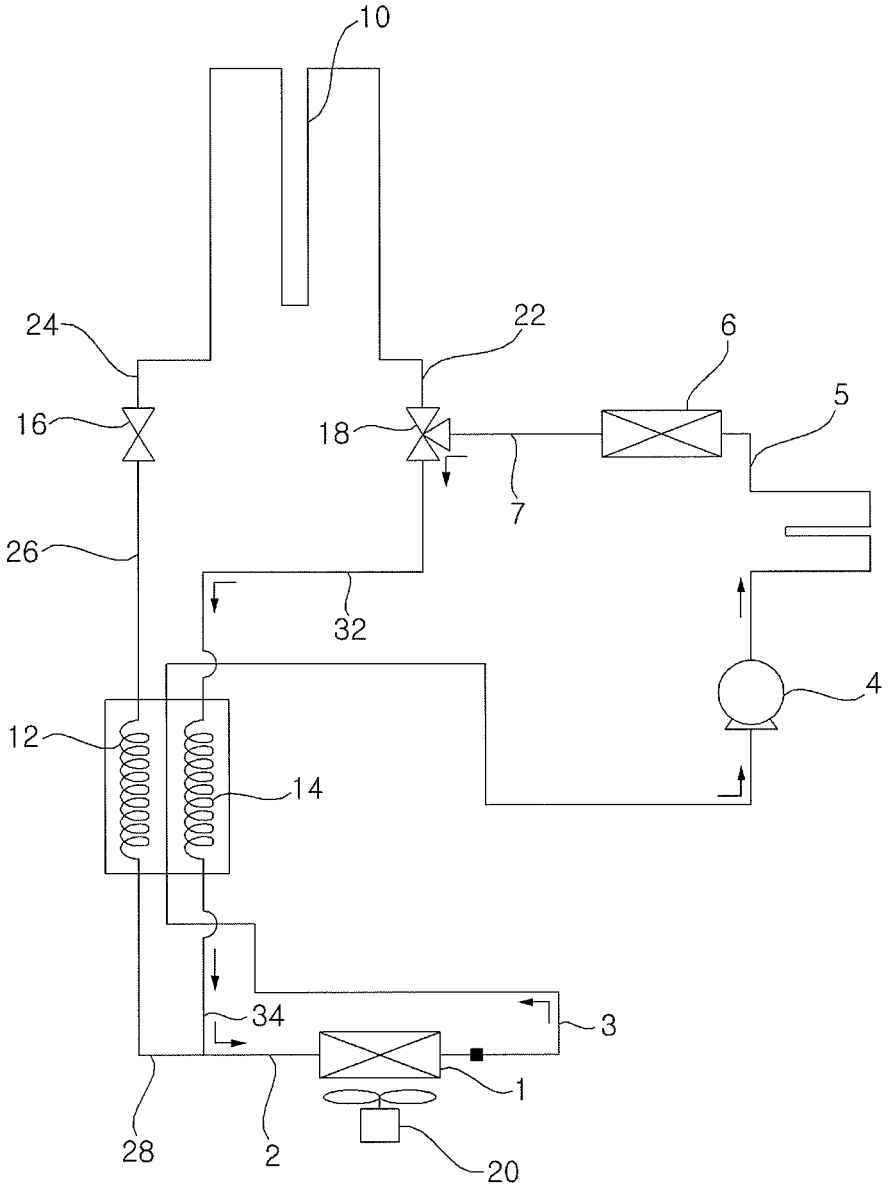
FIG. 3 is a configuration view illustrating a coolant flow in case a coolant, which passed through the condenser shown in FIG. 1 bypasses the hot line.
Figure 4:
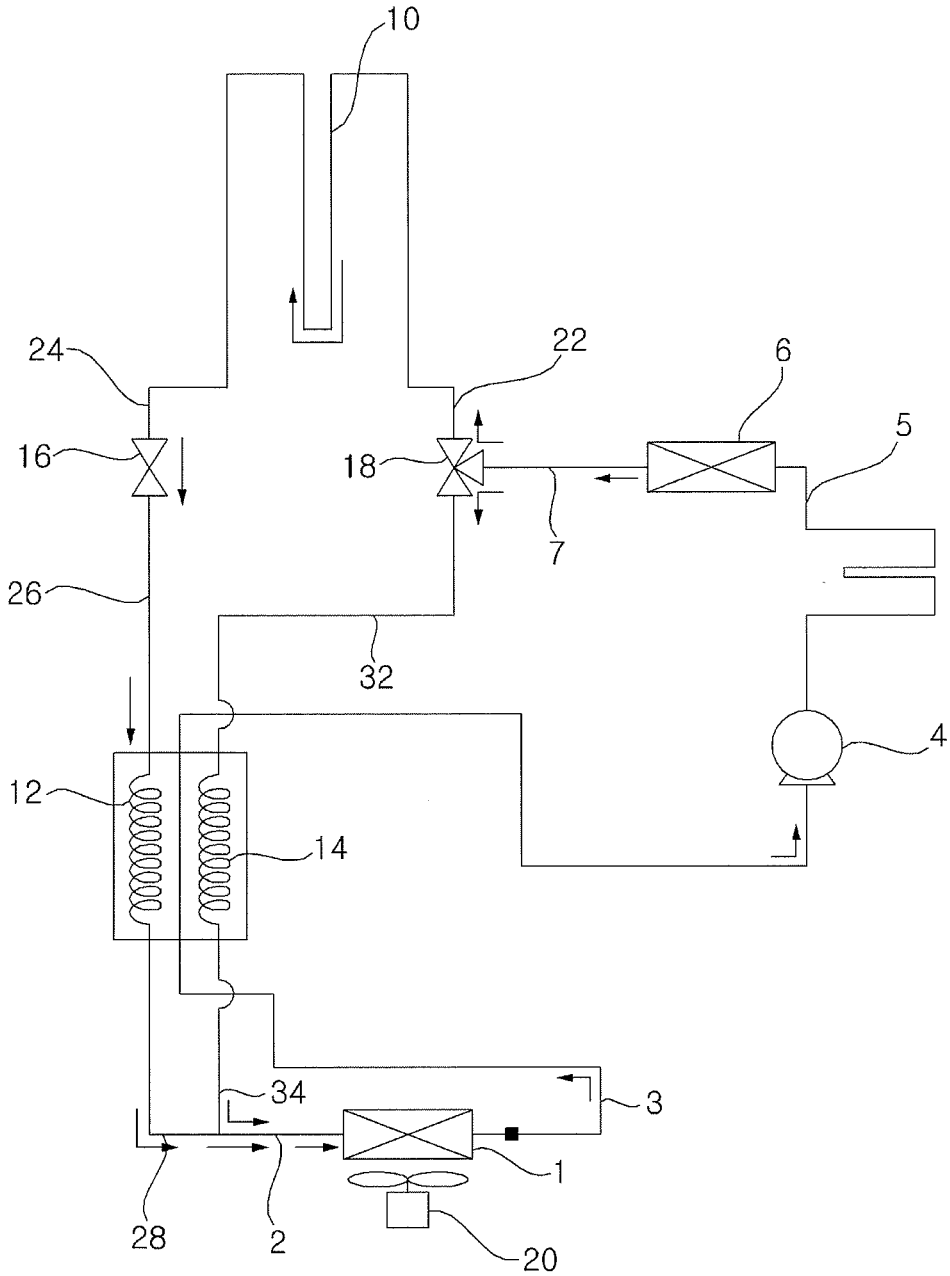
FIG. 4 is a configuration view illustrating a coolant flow in case a coolant that has passed through the condenser shown in FIG. 1 goes through the hot line, the first capillary tube, and a second capillary tube.

FIG. 1 is a configuration view illustrating an embodiment of a refrigerator according to the present invention, FIG. 2 is a configuration view illustrating a coolant flow in case a coolant, which passed through the condenser shown in FIG. 1 goes through a hot line and a first capillary tube, FIG. 3 is a configuration view illustrating a coolant flow in case a coolant, which passed through the condenser shown in FIG. 1 bypasses the hot line, and FIG. 4 is a configuration view illustrating a coolant flow in case a coolant that has passed through the condenser shown in FIG. 1 goes through the hot line, the first capillary tube, and a second capillary tube.

The refrigerator according to this embodiment includes an evaporator 1 that evaporates the coolant and cools the storage compartment; a compressor 4 that compresses the coolant evaporated in the evaporator 1; a condenser 6 that condenses the coolant compressed in the compressor 4; a hot line 10 through which the coolant condensed in the condenser 6 passes; a first capillary tube 12 through which the coolant having passed through the hot line 10 passes; a second capillary tube 14 through which the coolant condensed in the condenser 6 passes by bypassing the hot line 10; a first coolant adjusting valve 16 that adjusts the coolant flowing from the hot line 10 to the first capillary tube 12; and a second coolant adjusting valve 18 that adjusts the coolant flowing from the condenser 6 to the hot line 10 and the second capillary tube 14.

The refrigerator may include a storage compartment, such as a freezing compartment and a refrigerating compartment, and may further include a mechanical compartment in which the compressor 4 may be installed. The refrigerator may include a main body including the storage compartment and the mechanical compartment and a door provided at the main body to open and close the storage compartment. The main body may include an outer casing forming the appearance and an inner casing arranged in the outer casing and having a surface open. The storage compartment is provided in the inner casing. The door may include a gasket bought in tight contact with a surface oriented toward the main body.

The evaporator 1 may cause evaporation by performing heat exchange between the coolant having passed through at least one of the first capillary tube 12 and the second capillary tube 14 and the inside of the refrigerator. The evaporator 1 may be connected to an evaporator inlet path 2 that guides the coolant passing through at least one of the first capillary tube 12 and the second capillary tube 14 to the evaporator 1. The evaporator 1 may be connected to the compressor 4 via an evaporator compressor connecting path 3. The coolant evaporated in the evaporator 1 may be introduced to the compressor 4 through the evaporator compressor connecting path 3. The evaporator 1 may be provided at an outer wall of the inner casing or in the inner casing. The refrigerator may be configured as a direct cooling type refrigerator in which the evaporator 1 cools the inner casing and in-refrigerator air cools the storage compartment by conductance and natural convection. The refrigerator may be configured as an indirect cooling type refrigerator in which the evaporator 1 is provided outside the storage compartment and in-refrigerator air is forcedly circulated between the storage compartment and the evaporator 1 to cool the storage compartment. When configured as an indirect cooling type refrigerator, the refrigerator may further include an evaporator fan 20 that blows in-refrigerator air to the evaporator 1.

The compressor 4 may receive and compress the coolant evaporated in the evaporator 1 and may discharge the compressed coolant. The compressor 4 may be connected to the condenser 6 via a compressor-condenser connecting path 5. The coolant compressed in the compressor 4 may be guided to the condenser 6 through the compressor-condenser connecting path 5. The compressor 4 may be provided in the mechanical compartment formed in the refrigerator.

The condenser 6 may condense the coolant compressed in the compressor 4. The condenser 6 may be connected to a condenser outlet path 7 that guides the coolant having passed through the condenser 6. The condenser outlet path 7 may be connected to an outlet of the condenser 6. The condenser outlet path 7 may be connected to first paths 22, 24, 26, and 28 and second paths 32 and 34 to be described later. The coolant condensed in the condenser 6 may flow into only one of the first capillary tube 12 and the second capillary tube 14 or may be distributed to the first capillary tube 12 and the second capillary tube 14 by the first paths 22, 24, 26, and 28 and the second paths 32 and 34. The condenser 6 may be provided in the mechanical compartment formed in the refrigerator or may be exposed to the outside of the refrigerator.

The hot line 10 may be configured so that the coolant passing through the condenser 6 evaporates and removes water drops formed at the refrigerator. The hot line 10 may include a coolant pipe installed at a part of the main body which contacts the door. The hot line 10 may be provided between the inner casing and the outer casing of the main body and may radiate heat through the outer casing. Of the coolant passing through the condenser 6, gaseous coolant may radiate heat while passing through the hot line 10 and may be thereby condensed, and water drops formed at a region where the main body and the door contact each other may be removed by the heat transferred from the hot line 10.

The refrigerator may include first paths 22, 24, 26, and 28 through which the coolant flowing from the condenser 6 sequentially passes through the hot line 10 and the first capillary tube 12 and second paths 32 and 34 through which the coolant flowing from the condenser 6 passes through the second capillary tube 14.

The first paths 22, 24, 26, and 28 and the second paths 32 and 34 may be split past the outlet of the condenser 6 in the direction of the flow of the coolant and may then join before reaching the inlet of the evaporator 1. The first paths 22, 24, 26, and 28 and the second paths 32 and 34 may be split at the condenser outlet path 7 and may join at the evaporator inlet path 2.

The first paths 22, 24, 26, and 28 may include a hot line inlet path 22 guiding the coolant to the hot line 10, a hot line outlet path 24 guiding the coolant having passed through the hot line 10 to the first coolant adjusting valve 16, a first capillary tube inlet path 26 guiding the coolant having passed through the first coolant adjusting valve 16 to the first capillary tube 12, and the first capillary tube outlet path 28 guiding the coolant having passed through the first capillary tube 12.

The second paths 32 and 34 may include the second capillary tube inlet path 32 guiding the coolant to the second capillary tube 14 and the second capillary tube outlet path 34 guiding the coolant having passed through the second capillary tube 14.

The hot line inlet path 22 and the second capillary tube inlet path 32 may be connected to the condenser outlet path 7 or may be connected to the condenser outlet path 7 via the second coolant adjusting valve 18. The first capillary tube outlet path 28 and the second capillary tube outlet path 34 may be connected to the evaporator inlet path 2.

The first capillary tube 12 and the second capillary tube 14 may have the same inner diameter. The first capillary tube 12 may have an inner diameter larger than that of the second capillary tube 14.

The first coolant adjusting valve 16 may be a 2-way valve. The first coolant adjusting valve 16 may be a latch valve that maintains the closing or opening state of the valve by using the polarity of a magnet. When configured as a solenoid latch valve using a magnet, the first coolant adjusting valve 16 may control opening or closing of the valve by making as high current as able to offset the magnetic flux of the magnet instantaneously flow through a coil.

The second coolant adjusting valve 18 may have a hot line mode in which the coolant passing through the condenser 6 is guided to the hot line 10, a second capillary tube mode in which the coolant passing through the condenser 6 is guided to the second capillary tube 14, and a simultaneous mode in which the coolant passing through the condenser 6 is guided to the hot line 10 and the second capillary tube 14.

The second coolant adjusting valve 18 may include one 3-way valve. The second coolant adjusting valve 18 may include a 3-way valve at a region where the first paths 22, 24, 26, and 28 and the second paths 32 and 34 are split. The second coolant adjusting valve 18 may be connected to the hot line inlet path 22, the second capillary tube inlet path 32, and the condenser outlet path 7.

In case, in the refrigerator, the compressor 4 is driven, the first coolant adjusting valve 16 is open, and the second coolant adjusting valve 18 operates in the hot line mode, the coolant may flow as shown in FIG. 2. The coolant compressed in the compressor 4 is condensed while passing through the condenser 6, and then goes through the hot line 10 to thereby heat surroundings of the hot line 10. The coolant having passed through the hot line 10 flows through the first capillary tube 12 while being decompressed, and then flows into the evaporator 1 where the coolant is then evaporated.

In case, in the refrigerator, the compressor 4 is driven, and the second coolant adjusting valve 18 operates in the second capillary tube mode, the coolant may flow as shown in FIG. 3. The coolant compressed in the compressor 4 is condensed while passing through the condenser 6 and is then decompressed while passing through the second capillary tube 14, and then flows to the evaporator 1 where the coolant is then evaporated.

In case, in the refrigerator, the compressor 4 is driven, the first coolant adjusting valve 16 is open, and the second coolant adjusting valve 18 operates in the simultaneous mode, the coolant may flow as shown in FIG. 4. The coolant compressed in the compressor 4 is condensed while passing through the condenser 6. Some of the coolant condensed in the condenser 6 heats surroundings of the hot line 10 while passing through the hot line 10 and is then decompressed while going through the first capillary tube 12, and then flows to the evaporator 1. The rest of the coolant condensed in the condenser 6 is decompressed while passing through the second capillary tube 14, and then flows to the evaporator 1. The coolant decompressed while passing through the first capillary tube 12 and the coolant decompressed while passing through the second capillary tube 14 are mixed to each other before flowing into the evaporator 1 and are then introduced to the evaporator 1 where the coolant is then evaporated.

Figure 5:
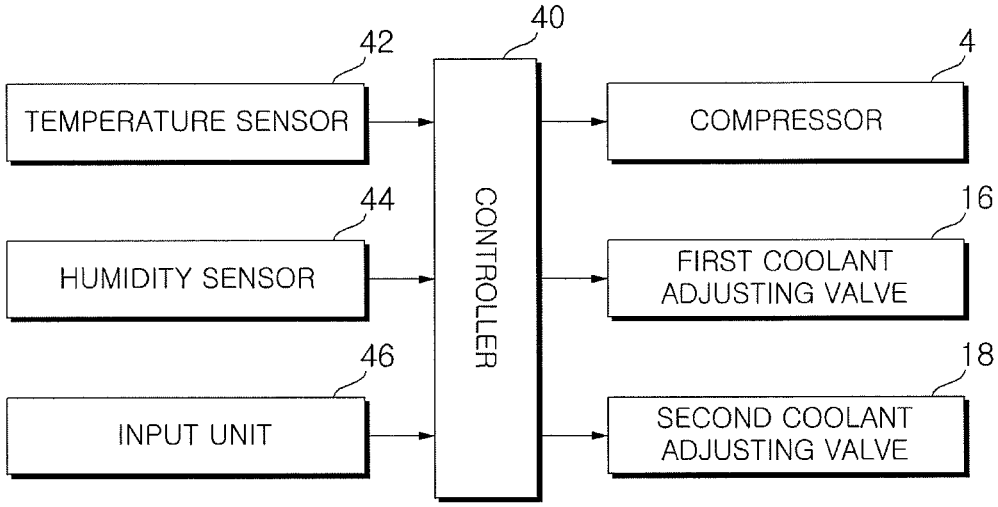
FIG. 5 is a control block diagram illustrating an embodiment of a refrigerator according to the present invention.
Figure 6:
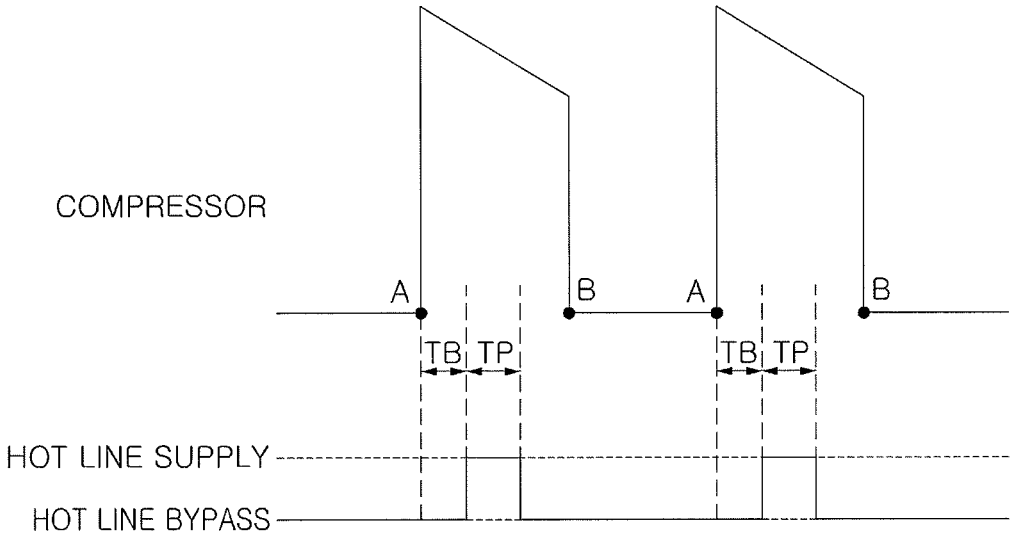
FIG. 6 is a view illustrating driving of a compressor and a hot line bypass of an embodiment of a refrigerator according to the present invention.

FIG. 5 is a control block diagram illustrating an embodiment of a refrigerator according to the present invention, and FIG. 6 is a view illustrating driving of a compressor and a hot line bypass of an embodiment of a refrigerator according to the present invention.

The refrigerator may include a controller 40 that controls a compressor 4, a first coolant adjusting valve 16, and a second coolant adjusting valve 18. The controller 40 may control the first coolant adjusting valve 16 in the opening mode when the second coolant adjusting valve 18 is in the hot line mode. When the second coolant adjusting valve 18 is in the simultaneous mode, the controller 40 may control the first coolant adjusting valve 16 in the opening mode. When the second coolant adjusting valve 18 is in the second capillary tube mode, the controller 40 may control the first coolant adjusting valve 16 in the closing mode.

The refrigerator may further include a temperature sensor 42 that senses an indoor temperature, and a humidity sensor 44 that senses humidity. The refrigerator may further an input unit 46 through which a desired temperature of the storage compartment may be input. The controller 40 may operate the refrigerator according to an input of the input unit 46, and may determine a time of flow of the coolant to the hot line 10 depending on the sensing results of the temperature sensor 42 and the humidity sensor 44.

The controller 40 may control the second coolant adjusting valve 18 in the second capillary tube mode during a preset time TB after the compressor 4 is activated. Here, the preset time TB is a time during which the coolant condensed in the condenser 6 is bypassed to the second capillary tube 14 without being supplied to the hot line.

After the preset time TB passes, the controller 40 may control the second coolant adjusting valve 18 in one of the hot line mode and the simultaneous mode. During a hot line condenser supply time TB, the controller 40 may control the second coolant adjusting valve 18 in one of the hot line mode and the simultaneous mode. Here, the hot line coolant supply time TP is a time during which the whole or part of the coolant of the coolant condensed in the condenser 6 is supplied to the hot line. The hot line coolant supply time TP during which the coolant is supplied to the hot line 10 may be determined depending on sensing results of the temperature sensor 42 and the humidity sensor 44. If the sensed value of the temperature sensor 42 is low and the sensed value of the humidity sensor 44 is low, the controller 40 may set the hot line coolant supply time TP to be short, and if the sensed value of the temperature sensor 42 is high, and the sensed value of the humidity sensor 44 is high, the controller 40 may set the hot line coolant supply time TP to be long. The controller 40 may set the hot line coolant supply time TP by inputting the sensed values of the temperature sensor 42 and the humidity sensor 44 into an equation or a table. Meanwhile, the controller 40 may control the second coolant adjusting valve 18 in the second capillary tube mode before the compressor 4 is stopped.

In the refrigerator, when the evaporator inlet path 2 is activated A and then stopped B, the second coolant adjusting valve 18 may be controlled in the second capillary tube mode during a preset time, after the preset time TB passes, the second coolant adjusting valve 18 may be controlled in one of the hot line mode and the simultaneous mode during the hot line coolant supply time TP, and after the hot line coolant supply time TP passes, may be controlled back in the second capillary tube mode.

The controller 40 may control the second coolant adjusting valve 18 in the simultaneous mode upon overload (condition that a large coolant circulation amount is needed). Upon low load (condition that a small coolant circulation amount is needed), the controller 40 may control the second coolant adjusting valve 18 in one of the hot line mode and the second capillary tube mode.

If the temperature of the storage compartment is higher than a preset temperature or a speed at which the temperature of the storage compartment decreases is lower than a preset speed, the controller 40 determines that the refrigerator is in the state of overload, and controls the first coolant adjusting valve 16 in the opening mode so that the coolant is distributed to the first capillary tube 12 and the second capillary tube 14 while controlling the second coolant adjusting valve 18 in the simultaneous mode.

If the temperature of the storage compartment is lower than the preset temperature or the speed at which the temperature of the storage compartment decreases is higher than the preset speed, the controller 40 determines that the refrigerator is in the state of the low load, and may control, the second coolant adjusting valve 18 in one of the hot line mode and the second capillary tube mode.

Hereinafter, the operation of the present invention configured as above is described as follows.

First, if the second coolant adjusting valve 18 is controlled in the second capillary tube supply mode and the compressor 4 is activated (A), the coolant discharged from the compressor 4 may be condensed while passing through the condenser 6 as shown in FIG. 3, and may be then evaporated in the evaporator 1 after passing through the second capillary tube 14. The coolant evaporated in the evaporator 1 may be sucked to the compressor 4, and the evaporator 1 may cool the storage compartment while the coolant is circulated through the compressor 4, the condenser 6, the second capillary tube 14, and the evaporator 1. At this time, the first coolant adjusting valve 16 may be closed to restrict the flow of the coolant between the hot line 10 and the first capillary tube 12.

Thereafter, while the compressor 4 is driven, the second coolant adjusting valve 18 may be switched to the simultaneous mode and the hot line mode, and the first coolant adjusting valve 16 may be open. In case the refrigerator is subjected to high load, the second coolant adjusting valve 18 may be switched to the simultaneous mode, and in case the refrigerator is subjected to low load, the first coolant adjusting valve 16 may be switched to the hot line mode. First, if the second coolant adjusting valve 18 is switched to the simultaneous mode and the first coolant adjusting valve 16 is open while the compressor 4 is driven, the coolant discharged from the compressor 4 is condensed while passing through the condenser 6, and is distributed, so that some of the coolant passing through the condenser 6 goes to the first capillary tube 12 via the hot line 10, and the rest of the coolant passing through the condenser 6 goes through the second capillary tube 14. The coolant passing through the first capillary tube 12 and the coolant passing through the second capillary tube 14 are mixed before flowing to the evaporator 1 and are then introduced to the evaporator 1 where the coolant is then compressed, and is then sucked to the compressor 4.

The coolant may be circulated through the compressor 4, the condenser 6, the hot line 10, the first capillary tube 12, and the evaporator 1, and through the compressor 4, the condenser 6, the first capillary tube 12, and the evaporator 1. As the coolant is distributed to the first capillary tube 12 and the second capillary tube 14 in the simultaneous mode, the amount of coolant circulated along the cooling cycle increases, so that the evaporator 1 may swiftly cool the storage compartment. If the second coolant adjusting valve 18 is switched to the hot line mode and the first coolant adjusting valve 16 is open while the compressor 4 is driven, the coolant discharged from the compressor 4 is condensed while passing through the condenser 6 as shown in FIG. 2, and then passes through the first capillary tube 12 to the evaporator 1 which may then evaporate the coolant. The coolant evaporated in the evaporator 1 may be sucked to the compressor 4, and the evaporator 1 may cool the storage compartment while the coolant is circulated through the compressor 4, the condenser 6, the first capillary tube 12, and the evaporator 1.

Hereinafter, while the compressor 4 is driven, the second coolant adjusting valve 18 may be switched to the second capillary tube supply mode, and the evaporator 1 may cool the storage compartment while the coolant discharged from the compressor 4 is circulated through the compressor 4, the condenser 6, the second capillary tube 14, and the evaporator 1 as shown in FIG. 3. At this time, the first coolant adjusting valve 16 may be closed to restrict the flow of the coolant between the hot line 10 and the first capillary tube 12.

After the second coolant adjusting valve 18 is switched to the second capillary tube supply mode as described above, the compressor 4 may be stopped (B).

Figure 7:
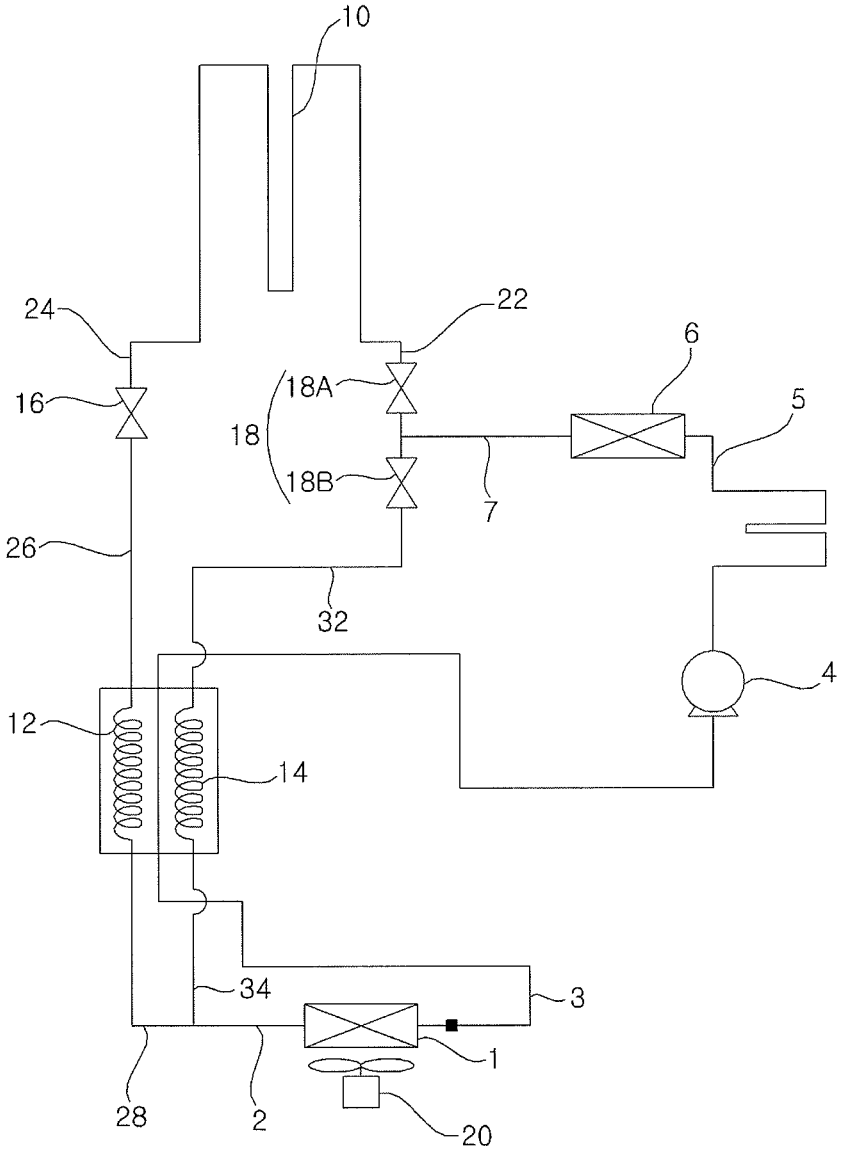
FIG. 7 is a configuration view illustrating another embodiment of a refrigerator according to the present invention.

FIG. 7 is a configuration view illustrating another embodiment of a refrigerator according to the present invention.

In the refrigerator according to this embodiment, the second coolant adjusting valve 18 may include a plurality of 2-way valves, and the configuration and operation other than the second coolant adjusting valve 18 are the same or similar to those of the first embodiment of the present invention, and thus the detailed description is not repeated, wherein the same reference numerals are used to denote the same elements.

The first path 2-way valve 18A may be closed in the second capillary tube supply mode, and may be open in the simultaneous mode and hot line mode.

The second 2-way valve 18B may be provided at a second capillary tube inlet path 32. The second path 2-way valve 18B may be configured as a latch valve. The second path 2-way valve 18B may be open in the second capillary tube mode. The second path 2-way valve 18B may be closed in the hot line mode. The second path 2-way valve 18B may be open in the simultaneous mode.

The second path 2-way valve 18B may be closed in the hot line mode, and may be open in the simultaneous mode and second capillary tube supply mode.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A refrigerator comprising:

an evaporator configured to evaporate a coolant and to cool a storage compartment;

a compressor configured to compress the coolant evaporated in the evaporator;

a condenser configured to condense the coolant compressed in the compressor;

a hot line configured to receive condensed coolant;

a first capillary tube configured to receive condensed coolant from the hot line;

a second capillary tube configured to receive condensed coolant and arranged to allow bypassing of the hot line;

a first coolant adjusting valve configured to adjust flow of condensed coolant from the hot line to the first capillary tube;

a second coolant adjusting valve configured to control flow of condensed coolant from the condenser to the hot line and the second capillary tube, wherein the second coolant adjusting valve is configured to provide a hot line mode in which the coolant having passed through the condenser is guided to only the hot line, a second capillary tube mode in which the coolant having passed through the condenser is guided to only the second capillary tube, and a simultaneous mode in which the coolant having passed through the condenser is guided to the hot line and the second capillary tube; and a controller configured to control the compressor, the first coolant adjusting valve, and the second coolant adjusting valve, wherein the controller is configured to control the second coolant adjusting valve to be in the second capillary tube mode during a preset time after the compressor is activated, and, after the preset time passes, the controller is configured to control the second coolant adjusting valve to be in one of the hot line mode and the simultaneous mode.

2. The refrigerator of claim 1, wherein the first coolant adjusting valve is a latch valve.

3. The refrigerator of claim 1, wherein the second coolant adjusting valve is a 3-way valve.

4. The refrigerator of claim 1, wherein the controller is configured to control the second coolant adjusting valve to be in the second capillary tube mode prior to deactivating the compressor.

5. The refrigerator of claim 1, further comprising:

a temperature sensor sensing an indoor temperature; and a humidity sensor sensing a humidity, wherein a hot line coolant supply time during which the condensed coolant is supplied to the hot line is determined depending on sensing results of the temperature sensor and the humidity sensor.

6. The refrigerator of claim 1, wherein the controller controls the second coolant adjusting valve in the simultaneous mode upon an overload of the refrigerator.

7. The refrigerator of claim 1, wherein the controller controls the second coolant adjusting valve in one of the hot line mode and the second capillary tube mode upon a low load of the refrigerator.

8. The refrigerator of claim 1, wherein an inner diameter of the first capillary tube is the same size as an inner diameter of the second capillary tube.

9. The refrigerator of claim 1, wherein an inner diameter of the first capillary tube is larger than an inner diameter of the second capillary tube.

10. The refrigerator of claim 1, further comprising:

a first path defined by the condensed coolant flowing from the condenser sequentially passing through the hot line and the first capillary tube; and a second path along defined by condensed coolant flowing from the condenser passing through the second capillary tube, wherein the first path and the second path are split at a location beyond an outlet of the condenser in a coolant flowing direction and are rejoined before reaching an inlet of the evaporator.

11. The refrigerator of claim 10, wherein the second coolant adjusting valve includes a 3-way valve provided at a region where the first path and the second path are split.

12. The refrigerator of claim 10, wherein the second coolant adjusting valve includes a first path 2-way valve provided at the first path and a second path 2-way valve provided at the second path at location after the first path and the second path are split.

* * * * *